United States Patent [19]

Ludecke

[11] 4,167,852

[45] Sep. 18, 1979

[54] DIESEL ENGINE EXHAUST CLEANER AND BURNER

[75] Inventor: Otto A. Ludecke, Rochester, Mich.

[73] Assignee: General Motors Corporation, Detroit, Mich.

[21] Appl. No.: 872,360

[22] Filed: Jan. 26, 1978

[51] Int. Cl.[2] ..... F01N 3/00

[52] U.S. Cl. ..... 60/296

[58] Field of Search ..... 60/296, 311, 299, 303

[56] References Cited

U.S. PATENT DOCUMENTS

| | | | |
|---|---|---|---|
| 2,946,651 | 7/1960 | Houdry | 60/296 |
| 3,072,457 | 1/1963 | Bloch | 60/296 |
| 3,211,534 | 10/1965 | Ridgway | 60/296 |
| 3,824,788 | 7/1974 | Cole | 60/301 |
| 3,870,474 | 3/1975 | Houston | 60/296 |
| 3,889,464 | 6/1975 | Gardner | 60/296 |

*Primary Examiner*—Douglas Hart

*Attorney, Agent, or Firm*—Robert J. Outland

[57] ABSTRACT

An arrangement of dual element alternate flow exhaust cleaner and burner device for diesel engines is disclosed which provides trapping of particulates in the engine exhaust gases by their passage through either of the two elements. Collected particulates of carbon and other combustibles in the other nonactive element are electively incinerated by excess air or oxygen containing gas heated by a suitable burner or heater device. The incinerated products from the inactive element are redirected into the exhaust stream to pass through the active element for the cleansing of particulates remaining from the burnoff process before discharge.

3 Claims, 1 Drawing Figure

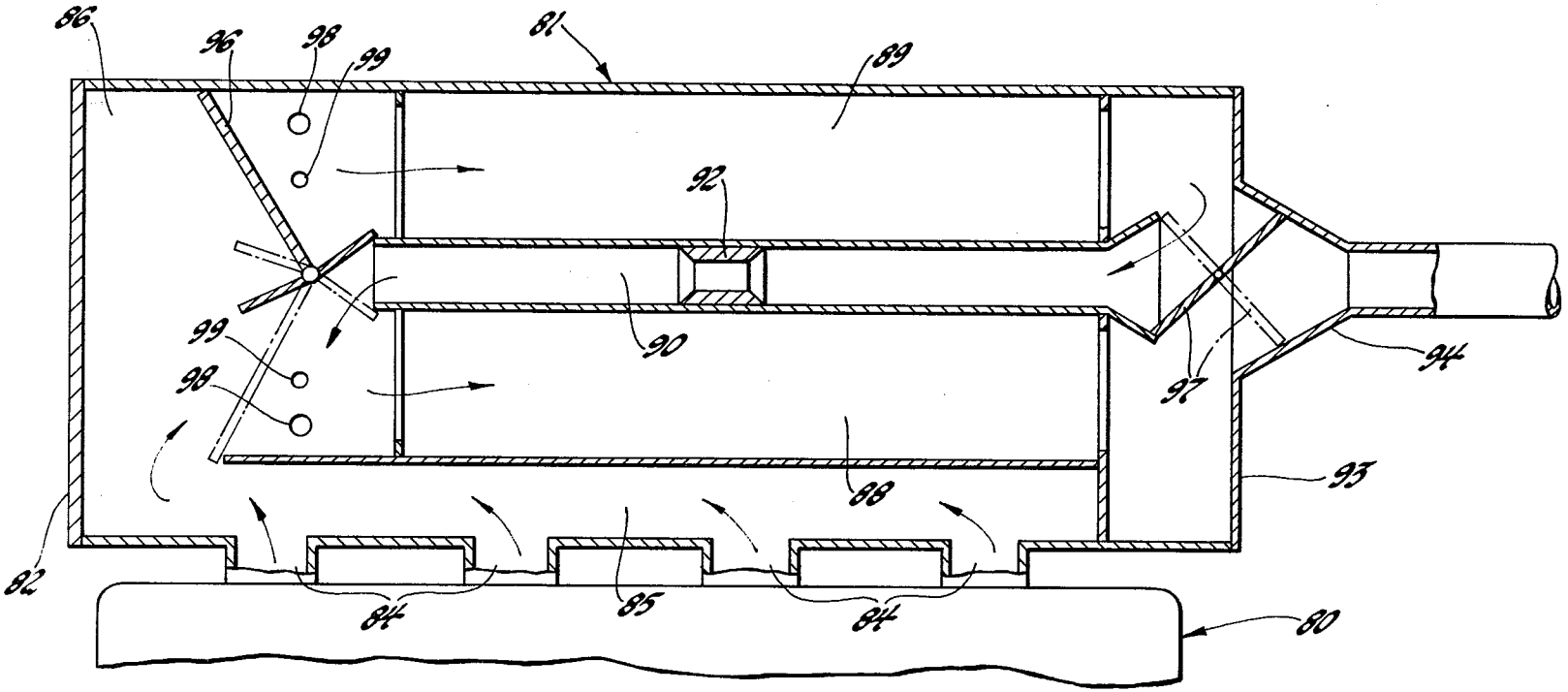
94
95
80
97
84
89
88
92
90
85
81
84
99
98
96
99
98
86
82

DIESEL ENGINE EXHAUST CLEANER AND BURNER

BACKGROUND OF THE INVENTION

This invention relates to diesel engine exhaust treatment and, more particularly, to a cleaner and burner device for collecting and disposing of carbon and other particulates in the exhaust gases of diesel engines.

It is known in the art to provide a diesel engine with an exhaust gas treatment device which, in operation, may collect particulates from the exhaust gas stream. Such particulates consist largely of carbon particles that tend to plug the treatment device, restricting exhaust gas flow and interfering with the gas treatment process. Restoration of such treatment devices to normal operation has been accomplished by provision of an auxiliary burner device comprising an air-fuel nozzle and ignition means which are operated when desired to heat the exhaust gases and the treatment device to the combustion temperature of the collected particulates, thus burning them off the treatment device surfaces and opening the flow paths therethrough to full exhaust flow.

It is further known in the related art of engine intake filters to provide an engine with dual elements which are alternately used for cleaning the engine intake gases, the nonactive element being self-cleaned from collections of foreign particles on its outer surface through the action of gravity which removes the collected particles from the surface when the intake airflow through the particular filter element is interrupted.

Also known in the prior art is the substitution of electric heating as an alternative for gas or fuel heating devices for general use and the use of electric heaters for exhaust gas treatment, including the burning of particulates collected in an exhaust gas purifier.

SUMMARY OF THE INVENTION

The present invention provides a diesel engine exhaust gas cleaning device with particulate incinerator having dual elements for alternate use of one of the elements while the other is cleaned and means for recycling (redirecting) the products of combustion from the particulate incineration process in the inactive element to the inlet of the active element for mixing with the engine exhaust gases. The arrangement combines some of the features of known prior art devices and concepts to provide a novel exhaust treatment package having the particular purpose of collecting and disposing of particulates in diesel engine exhaust gases. The recycling feature additionally provides cleaning of particulates from the incineration process together with those of the engine exhaust. The recycling (return) passage is preferably provided with a flame arrestor to prevent the carryover of flames from the incineration process to the active engine exhaust cleaning element so that burning of particulates in the active element is avoided.

These and other features of the invention will be more fully understood from the following description of a preferred embodiment, taken together with the accompanying drawing.

BRIEF DESCRIPTION OF THE DRAWING

In the drawing, the single FIGURE is a schematic part cross-sectional view showing the engine application of a preferred embodiment of dual element exhaust gas particulate trap and incinerator with recycling of incinerated products through the active trapping element for further cleaning in accordance with the invention.

DESCRIPTION OF THE ILLUSTRATED EMBODIMENT

Referring now to the drawing in more detail, there is shown a diesel engine generally indicated by numeral 80. Engine 80 has secured thereto an exhaust manifold with integral cleaner assembly 81 formed according to the invention.

The manifold assembly 81 includes a housing 82 having a plurality of inlet legs 84 disposed along one side of the housing and connecting with the engine exhaust ports, not shown, against which the manifold is secured. Legs 84 define exhaust inlet passages which lead into a longitudinal plenum 85 extending along one side of the manifold assembly. The plenum extends to a closed end 86 of the housing.

Spaced intermediate the ends of the housing are a pair of longitudinally extending, particulate trapping filter elements 88, 89 arranged in parallel relation and separated by a recycling passage 90 extending therebetween and having therein a flame arresting device 92. The end 93 of the housing opposite the closed end 86 includes an exhaust connection 94 defining an outlet passage for exhaust gases. At opposite ends of the housing between the end walls and the side by side mounted filter elements are diverter valves 96, 97. Between diverter valve 96 and the two filter elements there are disposed air-fuel atomizing nozzles 98 and ignition means 99 capable of supplying and burning a combustible mixture of air and fuel for passage through their associated filter elements.

The particulate trapping elements or filters 88, 89 may be of any construction suitable for use in a diesel engine exhaust system to collect particulates such as carbon particles and other combustibles present in the exhaust gas stream and which may be subsequently heated to the combustion temperature of the particulates for burning them off and cleaning the filter material. Suitable materials may include for example ceramic beads or monolithic ceramic structures similar to those currently used as catalyst support means in exhaust catalytic converters presently supplied with many gasoline fueled automobile engines in the United States. Metal wire mesh or multiple screen elements may also provide suitable filter element materials for this purpose.

In operation, exhaust gases from the engine 80 are directed through the passages defined by inlet legs 84 to the plenum chamber 85 from which they pass into the chamber at the closed end 86 of manifold housing. Here, diverter valve 96 is positioned to close the entrance to filter element 89 as shown in the drawing and directs the total exhaust gas flow through the then active filter element 88. Within the active filter element, carbon and other particulates are collected, and the cleaned exhaust gas passes out from the end of the element directly to the outlet connection 94 and thence to the connected vehicle exhaust pipe, not shown. If desired, some of the cleaned gas may be recirculated to the inlet of the diesel engine in a known manner.

Assuming that the inactive filter element 89 contains carbon and other particulates previously collected, it is possible to remove these particulates from the element by incineration. This is accomplished by supplying a combustible air-fuel mixture through nozzle 98 and igniting it by the igniter 99 associated with filter element 89. The air heated by combustion passes through the element 89, raising the particulates trapped therein to their combustion temperature and causing them to be burned off. The combustion products then pass out of the far end of filter element 89.

At this point, diverter valve 97, coacting with the walls and baffles of the housing, redirects the combustion products emanating from element 89 back through the recycling passage 90, the flame arrestor 92 suppressing the movement of any flame through the passage. The combustion products are then directed by diverter valve 96 to mix with the incoming engine exhaust gases and the mixture passes through filter element 88, so that not only the engine exhaust gases but also the combustion products from the incineration of particulates in filter element 89 are all passed through the active element 88 and cleaned. As previously noted, the cleaned gases from element 88 pass out of the manifold through the outlet connection 94.

When the collection of particulates in filter element 88 reaches a predetermined level that causes an undesired restriction of the passage of exhaust gases, manual or automatic controls, not shown, may be utilized to change the positions of the two diverter valves 96, 97 so that the flow of exhaust gases from the engine is through the alternate filter element 89 and the burn-off products from incineration of combustibles in element 88 are returned through the recycling passage 90 to the inlet of element 89 for cleaning of particulates therein in the manner previously described.

While the arrangement described shows one possible way in which a dual element particulate cleaner can be arranged to include the recycling of incineration products to the active element, it should be recognized that numerous other arrangements may be possible which would incorporate other features not specifically disclosed herein. Inasmuch as the disclosure of the preferred embodiment is illustrative only and not intended to limit the scope of the invention, it is intended that the invention be limited solely by the language of the following claims.

What is claimed is:

1. A cleaner for diesel engine exhaust gases for removing and disposing of carbon particulates discharged with the engine exhaust gases, said cleaner comprising housing means having a gas inlet and a gas outlet, a pair of particulate trapping elements in said housing means and formed of combustion resistant materials, each of said elements defining independent tortuous flow paths between said inlet and outlet capable of passing the full flow of exhaust gases from an associated engine while collecting particulates from the flowing gases, means for alternately directing at least the greater portion of engine exhaust gas flow from said inlet to either one of said elements while blocking the flow of such engine exhaust gases through the other element, means for electively passing through said other element a supplemental flow of combustion supporting gas and for heating said supplemental gas and particulates collected in said other element to the combustion temperature of the particulates for intermittantly incinerating the collected particulates, and means operative with said directing means for redirecting the incineration products from said other element into the path of gas flow into said one element for cleaning and passage therethrough with the flow of engine exhaust gases, thus providing for cleaning of the intermittant incineration products as well as of the engine exhaust gases.

2. A cleaner for diesel engine exhaust gases for removing and disposing of carbon particulates discharged with the engine exhaust gases, said cleaner comprising a housing having a gas inlet and a gas outlet, a pair of particulate trapping filter elements in said housing and formed of combustion resistant materials, said elements lying in spaced generally parallel relation and each defining tortuous flow paths between said housing inlet and outlet capable of passing the full flow of exhaust gases from an associated engine while collecting particulates from the flowing gases, flow directing means between said inlet and said filter elements and operative to alternately direct at least the greater portion of engine exhaust gas flow from said inlet to either one of said elements while blocking the flow of such engine exhaust gas through the other element, heated air supplying means between said flow directing means and said elements for electively passing through said other element a supplemental flow of hot combustion supporting gas to heat the particulates collected in said other element to their combustion temperature for intermittantly incinerating the collected particulates in said elements and redirecting means including a gas return passage between said spaced elements and a redirecting valve between the elements and the housing outlet, said redirecting means being operative with said directing means for redirecting the incineration products from said other element into the path of engine exhaust gas flow through said one element for cleaning and passage therethrough with the flow of engine exhaust gases, thus providing for cleaning of the intermittant incineration products as well as of the engine exhaust gases.

3. A diesel exhaust cleaner as defined in claim 2 wherein said gas return passage is provided with flame quenching means to prevent ignition of particulates in the one active filtering element by flame carryover from the other non-active filter element.

* * * * *